United States Patent [19]

Fritz et al.

[11] 4,215,825

[45] Aug. 5, 1980

[54] CRUSHER WITH IMPACTING BARS

[75] Inventors: Ulrich Fritz; Willibald Kamm; Thorwald Kipp; Udo Südmersen, all of Bad Oeynhausen, Fed. Rep. of Germany

[73] Assignee: Weserhütte Aktiengesellschaft, Fed. Rep. of Germany

[21] Appl. No.: 969,147

[22] Filed: Dec. 13, 1978

[51] Int. Cl.[2] ..... B02C 13/286

[52] U.S. Cl. ..... 241/34; 241/101.7; 241/138; 241/186.2

[58] Field of Search ..... 241/34, 101.7, 135, 241/138, 142, 186.1, 186.2, 186.3, 189 R, 190

[56] References Cited

U.S. PATENT DOCUMENTS

| | | | |
|---|---|---|---|
| 1,647,183 | 11/1927 | Leggemann | 241/189 R X |
| 1,988,473 | 1/1935 | Bennett | 241/138 X |
| 2,621,364 | 12/1952 | Stillman | 241/34 X |
| 2,669,271 | 2/1954 | Treckmann | 241/190 X |

FOREIGN PATENT DOCUMENTS

| | | | |
|---|---|---|---|
| 715858 | 12/1941 | Fed. Rep. of Germany | 241/190 |

*Primary Examiner*—Mark Rosenbaum
*Attorney, Agent, or Firm*—James E. Bryan

[57] ABSTRACT

This invention relates to an improvement in a roll crusher which crushes loaded material by impact and pressure, comprising a crusher housing, a loading hopper, a rotatable roll holding impacting tools, and fixed or adjustable crushing bars mounted to the crushing wall of the crusher housing, the improvement comprising two mutually oppositely rotatable rolls, each independent of the other and adapted to crush the material, mounted together with two oppositely located crushing walls in one common crusher housing, and a roof-like chute means mounted above a gap between the two rolls and adapted to distribute the material in the hopper and feed it to crushing regions.

3 Claims, 2 Drawing Figures

CRUSHER WITH IMPACTING BARS

This invention relates to roll crushers which crush loaded material by impact and pressure, comprising a crusher housing, a loading hopper, a rotating roll holding the impacting tools, and fixed or adjustable crushing bars mounted to the crushing wall of the crusher housing.

Single roll crushers are widely used because of their economy when crushing materials of low hardness such as coal, rock salt, etc., the loaded clumps being broken up by means of a rotating roll with impacting tools forcing them against a fixed or adjustable wall. Such single roll crushers are composed of a crusher housing, a rotatable roll with the impacting tools mounted theron, i.e., also rotatable and a fixed or adjustable crusher wall which may be smooth or serrated.

The broken-up material is removed underneath the crusher by a suitable conveyor which removes this material to another conveyor or shipping vehicle.

These crushers offer the advantage that they are economical to manufacture and that dust formation remains within tolerable limits.

They have, on the other hand, the drawback that their crushing efficiency is low compared to other crushing equipment.

Accordingly, where substantial crushing output is required, two or more crushers must be used side by side, whereby such equipment may be uneconomical compared to other units.

The invention therefore addresses the problem of providing an economical solution while retaining the same crushing procedure.

This problem is solved by the invention by mounting two rolls, rotatable in opposite directions and independently of each other, together in one crusher housing with two opposite crushing walls, and in that above the gap between the two rolls a roof-like metal element or chute divides the flow of material in the loading hopper and feeds it to the two crushing regions.

Because two single-roll crushers are integrated in one housing, the equipment operates more economically and also is more compact than if each single roll crusher were mounted in a special housing. Also, the loading surface of the input hopper is enlarged without the equipment operating at a greater height.

While two rolls are mounted in one housing in this construction, they do however differ fundamentally from the known two roll crushers which also comprise two rolls in one housing. The solution of the present invention offers two crushing regions, or two comminuting regions, namely between each roll and its crusher wall; the crushing processes in the two regions are independent of one another. Further, the two rolls can be driven independently of each other. In any event, material is not crushed in the space between the two rolls.

The reduction in size in the known equipment takes place between the two rolls, in other words, there is only one comminuting region. The direction of the roll rotation is mutually opposite, as is the case for the present invention. However, because the loaded material is fed only to one crushing region, the loading hopper and its loading surface will be smaller for the same height and the same wall slope in this invention.

In order to further improve the crushing process in the present invention, one or more rows of fixed and/or adjustable crushing bars may be mounted in each crushing region in such a manner that shorter crushing bars at greater spacings are mounted in the upper row and longer bars with lesser spacing reaching as far as the roll are mounted in the lower rows, the upper row being used for pre-reduction and the lower rows of crushing bars for post-reduction.

Another improvement is obtained in operation in that gridirons partly or wholly blocking the feed ducts to the two crushing chambers can be inserted independently of one another into these ducts and on one hand can limit or entirely stop the flow material in each crushing region independently of the other, and on the other hand may be used to unclog material by being suddenly forced inwardly or pulled out, and futhermore these gridirons can keep the material to be crushed from the rolls in the case of a power shortage or when the rolls are starting up or winding down, and thus prevent jamming of the crusher. The gridirons are automatically pushed in by compressed air or similar means the moment the crusher is shut off or shuts itself off in case of a malfunction. Accordingly, a feeder can be dispensed with. In known equipment the material is loaded by means of such feeders as conveyor belts, thrust loaders, etc., which uniformly remove the material from a preceding hopper. When the crusher is shut off or turns itself off, the feeder also is automatically turned off so the rolls are free from excess material. This is necessary as otherwise the rolls could not start up again.

The two rolls may be mounted at different heights, with the latitude of adaptation furthermore to the slope of the conveyor removing the crushed material.

Most appropriately, the integration of two single-roll crushers in one common housing may be designed as a mobile pre-crushing facility, the two single-roll crushers integrated in one housing together with their conveyor removing the crushed material being mounted on a substructure moving on wheels or tracks or other transport means.

The invention will be further illustrated by reference to the accompanying drawings, in which.

Figure 1:
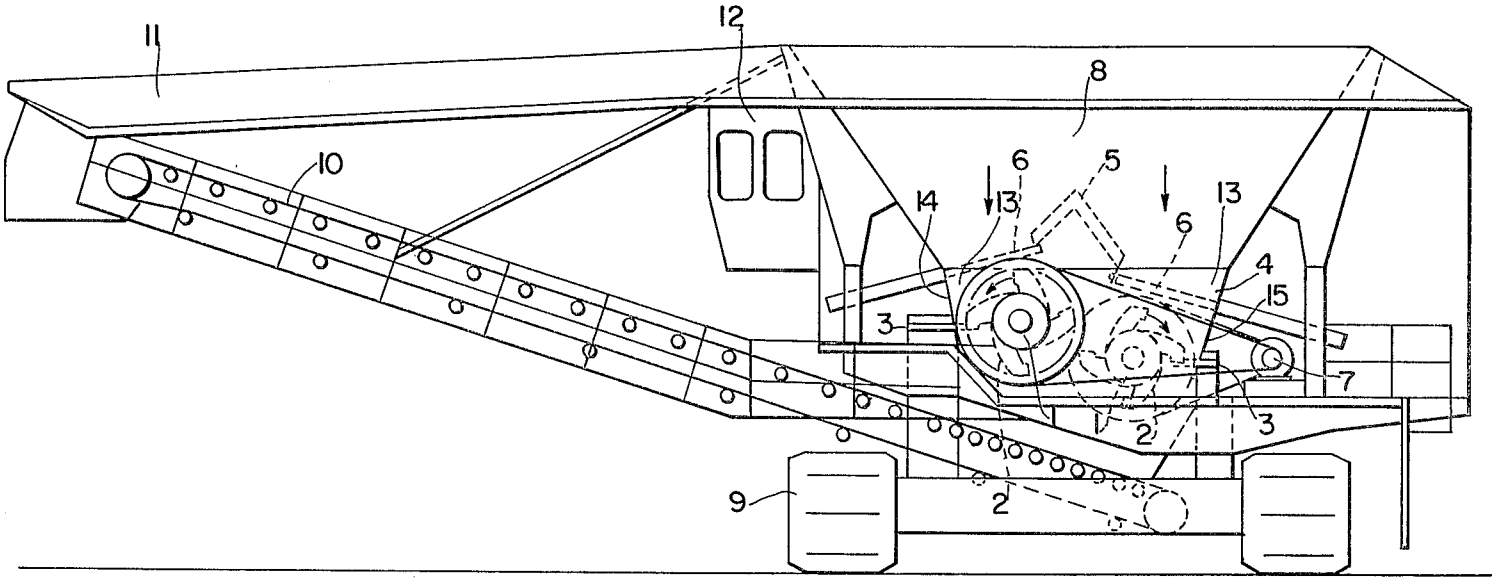
FIG. 1 is a cross-section of a mobile crusher with two rolls.
Figure 2:
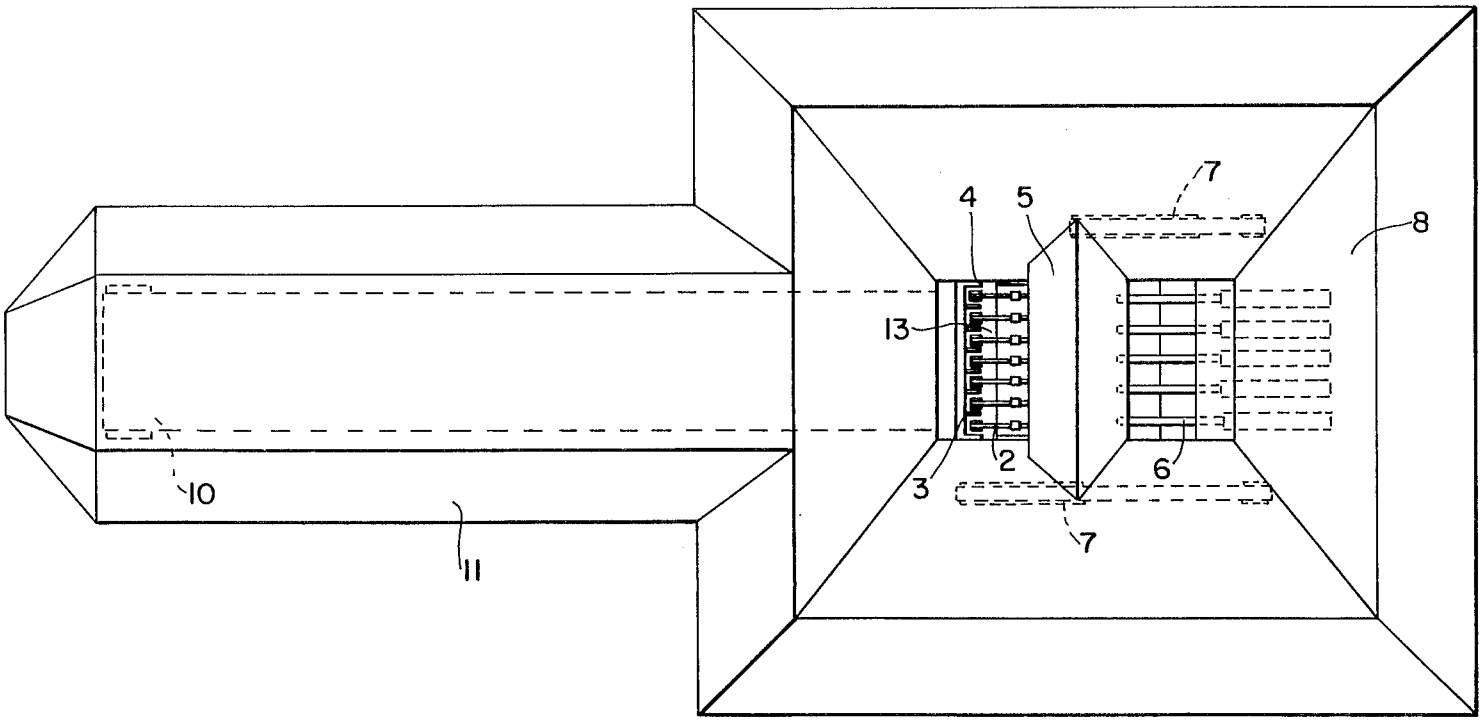
FIG. 2 is a top view of the crushing equipment.

The reference numerals denote the following:

1=crushing rolls
2=impact bars
3=fixed or adjustable crushing bars mounted to the crushing wall
4=the crusher housing
5=the roof-like chute over the rolls
6=the insertable gridirons
7=the V-belt drives for the two rolls
8=the loading hopper
9=the mobile substructure
10=conveyor belt
11=protective plate above conveyor belt and driver's cabin
12=driver's cabin
13=crushing chambers
14/15=crushing walls.

The material to be crushed is fed through the hopper 8 and the chute 5 to the two crushing chambers 13. In these crushing chambers, the loaded material is comminuted by the rotating impact bars 2 and the fixed or adjustable crushing bars 3. The crushed material leaving the underside of the crushing space is fed by the conveyor belt 10 to another conveying equipment such as a light truck or to another conveyor belt. By means of its mobile substructure 9 the equipment can change its site of operation.

The crushing bars are driven by known drives, preferably by V-belt drives 7. The two rolls are driven in mutually opposite rotation and are housed in a common crusher housing 4, whereby the equipment is both compact and has a large loading hopper. Loading can take place by means of belts, mobile loading equipment or excavating equipment.

The supply of the material to the crushing chambers can be blocked and even stopped entirely by using the movable gridirons 6. These movable gridirons also can be used to unclog the loaded material.

It will be obvious to those skilled in the art that many modifications may be made within the scope of the present invention without departing from the spirit thereof, and the invention includes all such modifications.

What is claimed is:

1. In a stationary or mobile roll crusher which crushes loaded material by impact and pressure, comprising a crusher housing, a loading hopper, a pair of mutually oppositely rotatable rolls holding impacting tools, and fixed or adjustable crushing bars mounted to the crushing wall of the crusher housing, the improvement comprising means mounting said pair of mutually oppositely rotatable rolls independently of the other together with two oppositely located crushing walls in one common crusher housing, roof-like chute means mounted above a gap between said pair of rolls and adapted to distribute the material in the hopper and feed it to crushing regions, and gridiron means independently insertable into feed ducts to the crushing regions, said gridiron means being capable of blocking in whole or in part said feed ducts and by step-like insertion or removal dissolving any material cloggings, and means whereby said gridiron means are automatically inserted upon power failure to prevent crusher jamming.

2. A roll crusher according to claim 1 including means mounting the two rolls at different heights which can be adapted to an incline of a conveyor belt removing comminuted material.

3. A roll crusher according to claim 1 including a mobile substructure means adapted to move on wheels or tracks, and supporting the crushing rolls, the loading hopper, and a conveyor for removing comminuted material.

* * * * *